United States Patent [19]

Flynn et al.

[11] 4,103,841

[45] Aug. 1, 1978

[54] HOSE REEL APPARATUS

[75] Inventors: Thomas P. Flynn; James C. Wurster, both of Milwaukee, Wis.

[73] Assignee: Super Products Corporation, Milwaukee, Wis.

[21] Appl. No.: 827,877

[22] Filed: Aug. 26, 1977

[51] Int. Cl.[2] ..... B65H 75/42

[52] U.S. Cl. ..... 242/86.2; 242/54 R; 242/75.2

[58] Field of Search ..... 242/54 R, 55, 75.2, 242/75.1, 75, 75.41, 75.42, 67.1 R, 67.3 R, 86, 86.1, 86.2, 156.1, 86.5 R, 99, 85, 86.7, 78.7, 68.7; 137/355.26

[56] References Cited

U.S. PATENT DOCUMENTS

| | | | |
|---|---|---|---|
| 2,364,201 | 12/1944 | Fankboner | 242/75.41 |
| 3,319,905 | 5/1967 | Kissilov | 242/86.2 |
| 3,774,630 | 11/1973 | Prange | 137/355.12 |

*Primary Examiner*—George F. Mautz

[57] ABSTRACT

A hose reel apparatus is disclosed which permits proper winding and unwinding of a hose, for example the water hose of a sewer cleaning machine. The apparatus includes a reel, preferably a power driven reel, for winding and unwinding a hose and a series of rollers coupled together by links. The rollers are positioned on the outside circumference of the hose windings in such a manner that a radial force is exerted on the hose causing hose windings to remain tight against the core of the reel. The preferred embodiment also includes means for holding the rollers against the windings whether the hose is fully wound, fully unwound or partially unwound, i.e. regardless of the circumference of the hose windings. This latter feature is accomplished by providing spring means coupled to the rollers and links to urge the rollers into contact with the hose.

9 Claims, 5 Drawing Figures

HOSE REEL APPARATUS

FIELD OF THE INVENTION

This invention relates generally to the art of hose reels and in particular to a hose reel apparatus which insures level winding and prevents pinching of a hose wound thereon. More specifically, the preferred embodiment of the invention relates to a hose reel apparatus useful for winding and unwinding a hose for supplying water under pressure, for example the hose used in supplying water to the sewer cleaning nozzle of a sewer cleaning machine.

BACKGROUND OF THE INVENTION

There are many prior art devices in the field of winding and reeling directed to the winding and unwinding of elongate materials such as cables, wires, lines, hoses etc. onto a reel for storage. For example, in the fishing reel art numerous prior art designs are known for level winding fishing line onto a reel and other designs are known for preventing backlash, pinching of the line and the like.

Also, many prior art devices are known for winding, unwinding and rewinding fluid hoses. Several examples of known fluid hose reels include garden hose reels, hose reels used on trucks which deliver fuel oil, fire hose reels on firetrucks, and the reels used for storing the water hose on sewer cleaning machines.

Level winding of hoses is only one problem which is discussed in the prior art. In hose reels used for storing fire hoses, for example, devices have been developed which permit the hose to be inflated with water under pressure while it is still on the hose reel. Without such a pressure compensating system the hose could pinch during unwinding and cause potentially serious delays at a fire. A device of this type is disclosed in Manahan's U.S. Pat. No. 2,777,646, issued Jan. 15, 1957 for an "Expansible-Contractable Hose Reel."

A typical level winding apparatus for fluid hoses is described in Gear's U.S. Pat. No. 2,301,208 issued Nov. 10, 1942 for "Hose Reel Apparatus." In this device a hose guide member travels back and forth over a worm gear as winding or unwinding of the hose progresses. While this type of device aids in level winding, it is not entirely satisfactory in solving backlash problems and is relatively complex from both operational and manufacturing standpoints. The device of the Gear patent is particularly well suited for use on tank vehicles employed for delivering fuel oil, gasoline, and the like.

Sewer cleaning devices have certain specific problems which require additional considerations in selecting an appropriate hose and reel combination. One known type of sewer cleaning machine includes a truck, a water tank (or a system for connecting the vehicle to a source of water, e.g. to a water hydrant), a hose and reel, a sewer cleaning nozzle connected to the end of the hose and pump means for forcing water under pressure through the nozzle. The nozzle can be selected from many different designs, but one commonly used type of nozzle includes rearwardly directed openings which create water jets when the water is forced through the hose. The jets develop sufficient force to drive the nozzle into a sewer lateral and in turn pull the hose into the lateral to wash debris therefrom into a catch basin. The water jets also dislodge accumulations of debris from within the sewer lines.

The hose commonly employed in sewer cleaning machines is about 1½ inches O.D. and may be several hundred feet long. Power drive means are provided for winding the hose on the reel and some machines also include hydraulic drive systems for feeding the hose into the catch basin. In addition to piling up and pinching of the hose, occurrences which are common in other types of hose carrying vehicles, this type of equipment can develop another related problem if the sewer cleaning nozzle is halted on its journey through a sewer line by an obstruction, such as a root or a piece of broken sewer pipe. The problem results in the hose continuing to flow from the hose reel during the time it takes for the machine operator to realize that the nozzle progress has been impeded and to stop the machine. The slack created in the hose can lead to loops falling off the reel into the drive gears of the hose drive system.

Manufacturers of sewer cleaning equipment have developed certain devices for solving the pile up and pinching problems. For example, Prange's U.S. Pat. No. 3,774,630 issued Nov. 27, 1973 for "Mobile Sewer or Like Cleaning Machine" describes a hose guide roller for permitting the use of narrow width, large diameter drums for the water hose. The roller insures that the hose is centered over the middle of the narrow reel. A simple hose guide roller of this type however does not solve the aforementioned problem of hose loops developing if unreeling continues while the nozzle at the end of the hose is obstructed. A hose reel apparatus which solves this and other related hose winding and unwinding problems would be a significant advance in this technology.

OBJECTS OF THE INVENTION

It is a primary object of the present invention to provide a hose reel apparatus which overcomes the above-noted disadvantages of the prior art.

An object of the present invention is to provide a hose reel on which a hose can be wound and unwound without the hose pinching and piling up.

Another object of the present invention is to provide a hose reel apparatus which prevents slack from developing in the hose windings on the reel as the hose is unwound.

Yet another object of the present invention is to provide a hose reel apparatus which accomplishes the above-noted advantages during all stages of hose capacity, i.e. when the hose reel is full, when it is being emptied and when the reel is substantially empty and rewinding begins.

How these and other objects of the invention are accomplished will be described in the following specification, taken in conjunction with the drawings. Generally, however, they are accomplished by providing a reel mounted for rotation about its axis on a frame. A hose is wound upon the reel and, in the preferred embodiment, includes means coupled to the inner end of the hose for supplying water under pressure through the hose. A series of rollers which are approximately as wide as the reel are coupled together and spaced apart by a series of steel links to form a chain which is wrapped around the outside of the hose windings. A first end of the roller and link assembly is rotatably secured to the reel support frame. The other end of the link and roller assembly is pulled tight around the hose windings in the direction of hose feed by spring means. As hose is unwound from the reel, the rollers press against the windings and "force" the hose off the reel while preventing the development of loops or hose backlash. As the diameter of the hose windings decreases during removal of the hose, the spring means continually draws the link and roller assembly tight around the remaining windings. The first link and roller are allowed to approach the core of the reel by the rotatable mounting thereof to the frame. When the hose is rewound onto the reel, the rollers press the hose onto the reel under the spring pressure and forceably spread out any piles of windings which may develop. The rollers also insure that all of the hose is contained within the reel and that loops cannot spill over onto the gears of the reel-drive system. As winding continues, the link and roller assembly continually stretches the spring means as more and more links of the roller chain are drawn into contact with the expanding circumference of the windings.

DESCRIPTION OF THE PREFERRED EMBODIMENT

Figure 1:
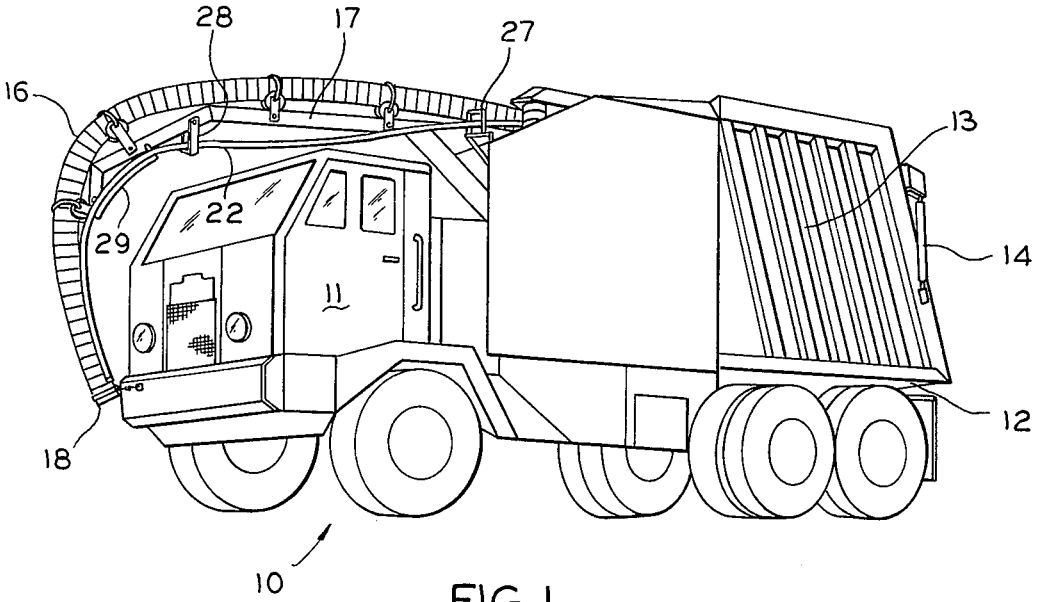
FIG. 1 is a perspective view of a sewer cleaning machine representing an illustrative vehicle with which the hose reel apparatus of the present invention may be used.

FIG. 1 shows in perspective view a sewer and catch basin cleaning vehicle 10 which represents one environment in which the hose reel apparatus of the present invention can be used. It should be clearly understood that the vehicle of FIG. 1 is shown solely for purposes of illustration and that the hose reel apparatus can be employed in numerous other mobile or stationary devices. For example, one skilled in the art, after reading the following specification, could readily adapt the principles of the present invention for such uses as fire and fuel delivery trucks, cable winding and cable laying equipment, etc.

The sewer and catch basin cleaner 10 generally includes a truck having a cab 11 and chassis 12. A body 13 is mounted rearwardly of the cab 11 and includes hydraulic cylinder means 14 for raising and lowering a tailgate (not shown) on body 13. Means may also be provided within body 13 for pushing accumulated debris from the body 13 out of the tailgate, or a system may be provided for tilting the body 13 to dump debris through the tailgate.

Two hoses are illustrated in FIG. 1. A first hose 16 is a vacuum intake hose and is typically employed for sucking debris from the collection site into body 13. Hose 16 is supported by an elevatable and rotatable boom 17 so that the free end 18 of hose 16 can be precisely located relative to the collection site. A vacuum creating pump (not shown), such as a positive displacement vacuum pump is provided for evacuating body 13 to create suction within hose 16. Screens and filters which are typically used in such equipment for preventing damage to the vacuum pump are included but are not shown in the sewer and catch basin cleaner 10 of FIG. 1.

Figure 2:
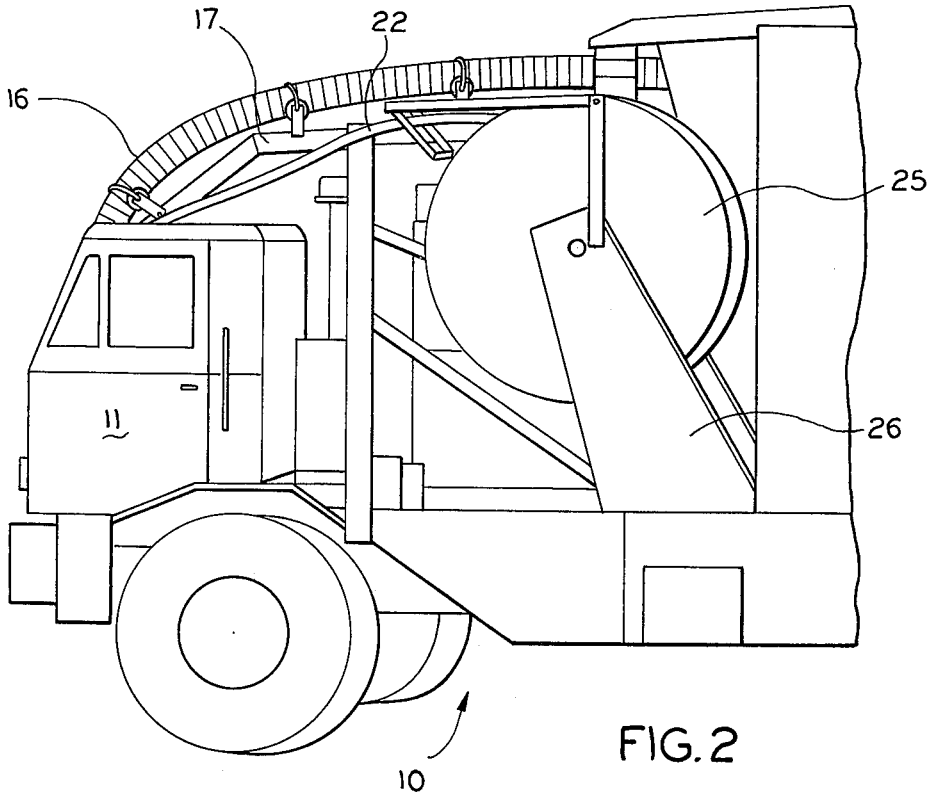
FIG. 2 is a side view, with parts broken away, of the vehicle of FIG. 1 showing in greater detail the hose apparatus of the present invention.

A second hose 22 is also provided on cleaner 10, which hose is provided for injecting water under pressure into a sewer line to wash accumulated debris into a catch basin for removal by hose 16. Hose 22 is wound upon a hose reel 25 (see FIG. 2) which in turn is mounted on a pair of stanchions 26 for rotation. Hose 22 after leaving reel 25 passes through a pair of guide members 27 and 28 and a hose guide cradle 29 on boom 17 so that the free end thereof may be positioned over a collection site along with vacuum hose 16.

The operation of sewer and catch basin cleaner 10 will now be described in general terms. The truck 12 is driven to the job location and parked so that the front of cab 11 is positioned generally adjacent a manhole. A rigid section tube (not shown) is coupled to the free end 18 of hose 16 and is lowered to the bottom of the catch basin. A sewer cleaning nozzle is then coupled to the free end of hose 22 and is inserted, with a suitable guide device, into a sewer lateral emptying into the catch basin. Most sewer systems are arranged so that some laterals slope upwardly and away from the catch basin while other laterals slope downwardly and away from the catch basin.

As discussed above, the nozzle preferred for use with cleaner 10 comprises a nozzle having a plurality of rearwardly directed openings which create water jets to drive the nozzle deep into the sewer lateral and flush debris therefrom. Water under pressure is injected into the hose 22 through a typical rotating drum coupling from a water pump or other source of water and hydraulic drives (not shown) on reel 25 pay out hose 22 from reel 25 until the nozzle has cleaned the desired portion of the sewer lateral. The reel drive means is then reversed to pull the hose 22 back out of the lateral while water under pressure continues to issue from the jets of the sewer cleaning nozzle. This causes additional cleaning of the sewer as well as flushing of debris from the lateral back to the catch basin. Suction is typically applied through hose 16 throughout the sewer cleaning operation.

Figure 3:
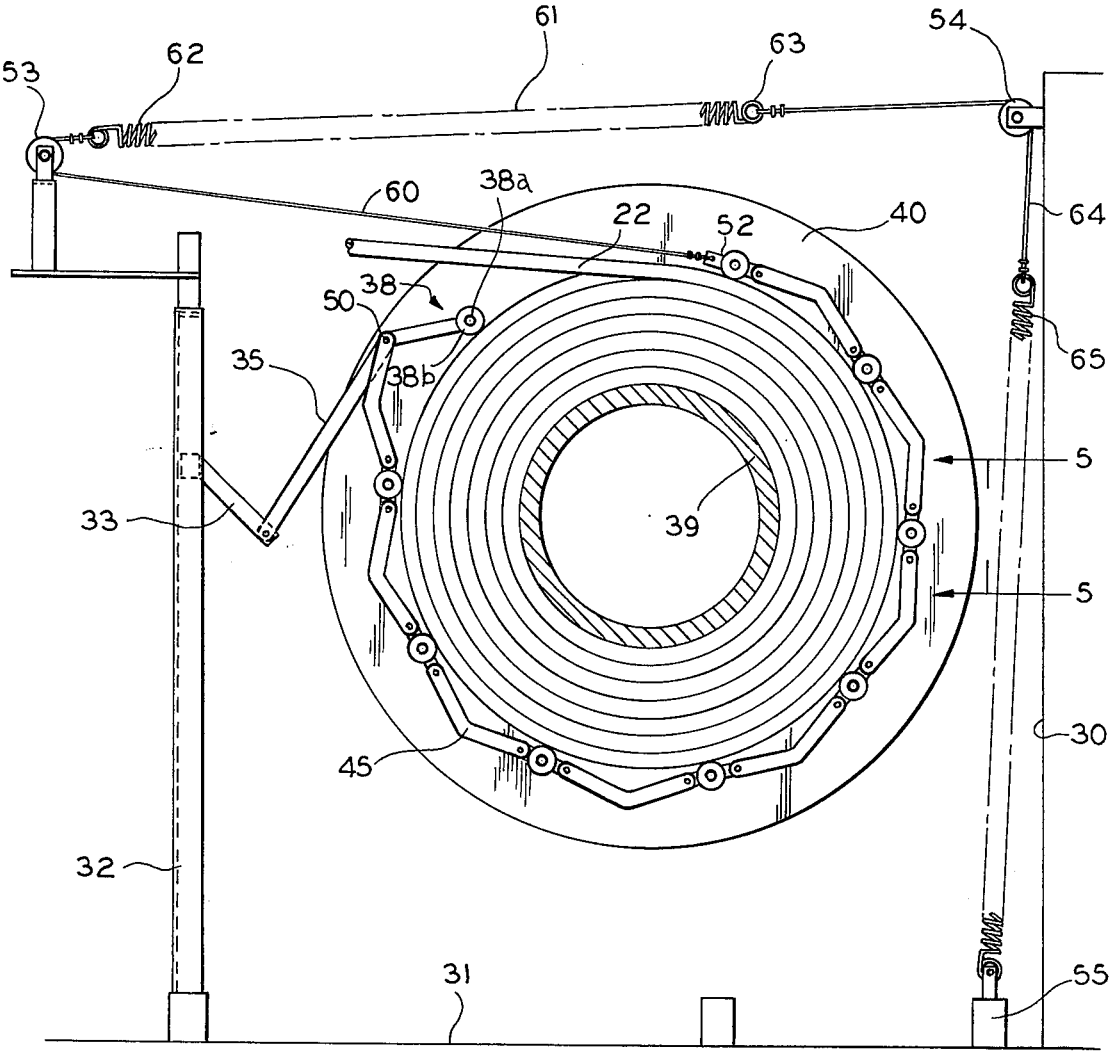
FIG. 3 is a detailed side view of the hose reel apparatus according to the preferred form of the present invention, showing the reel at full hose capacity.

Referring now to FIG. 3, hose 22 is shown fully wound on hose reel 25 which includes a core 39 and parallel sides 40. This FIGURE is shown with certain parts removed (i.e. the stanchions 26 for supporting hose reel 25 and the hose reel drive means) for purposes of more clearly showing the invention.

Reel 25 is supported for rotation at a location forward of the front wall 30 of the cleaner's water tank and above the floor 31 of truck chassis 12. Located between reel 25 and cab 11 is a support 32 which extends across chassis 12, and rigidly attached to frame 32 at a location which is approximately equal in height to the axis of reel 25 is an arm member 33. Arm 33 extends generally toward the core 39 of reel 25 intermediate the sides 40 thereof. Rotatably coupled to the end of arm 33 nearest the reel 25 is an elongate plate member 35, preferably with a bend with about 45° at its middle. Arm 35 should be long enough to reach the core 39 of reel 25 when it is empty. The preferred means for coupling arms 35 to arm 33 is by a clevis 36 and cotter pin 37, but other means can be employed for pivotally connecting these elements.

At the free end of arm 35, a first roller assembly 38 is provided. Assembly 38 includes two plastic rollers **38*a* mounted perpendicularly on either side of arm 35 by bolt means 38*b* passing through the axis of each roller. This permits the rollers to rotate about their axis. Nuts (not shown) provided for securing the rollers to the bolt means so that the axis of rollers 38*a* are parallel to the axis of reel 25**.

The rollers **38*a* are constructed so that the width of roller assembly 38 is just slightly less than the distance between the sides 40 of hose reel 25. From the foregoing description it will be appreciated that roller assembly 38 can be disposed at any distance from the core 39 of hose reel 25 depending on the quantity of hose wound thereon and that the assembly 38 can move through a circular arc having a midpoint of pin 37 and a radius defined by the length of plate member 35**.

A plurality of links 45 and additional roller assemblies 46 (see FIG. 5) are coupled together to form a chain 47. As can be seen by simultaneous reference to FIGS. 3, 4 and 5, each link includes a pair of flat elongate plates **45*a* having approximately a 45° bend at their middle. Two pairs of such plates are each rotatably joined to a roller assembly plate 48 by nuts, bolts and appropriate washers 49 and each of such plates 48 supports a pair of rollers 41 similar to those described for roller assembly 38. In the illustrated embodiment, eight links 45 and eight roller assemblies 46 form the chain 47. The particular number employed will depend on the size of the hose reel 25 and the length of the links 45 and total footage of hose to be carried on reel. The length of chain 47 should be chosen such that chain 47 is a little shorter than the maximum circumference of one of the hose windings on hose reel 25**.

One end of chain 47 is pivotally joined to arm 35 by placing the first pair of link plates 48 adjacent the midpoint bend of arm 35 and rotably securing same thereto by a pin 50. The chain 47 is then wound around the bottom of hose reel 25 and then to the top of the hose windings (see FIG. 3) so that the chain terminates in a roller plate 48 having only one set of link plates 45 attached thereto. This plate will be referred to as plate 52. In the desired construction, plate 52 will be generally at the top of hose reel 25 when the reel is full.

The present invention also provides a means for maintaining contact between rollers **38*a* and 41 and the hose winding, the system including a series of wire cables, springs and pulleys. There are two of such pulleys 53 and 54 mounted, respectively, above and forward of the reel on support 32 and above and rearwardly of the hose reel 25 at the front wall of water tank 30. They are arranged with their axis parallel to the axis of hose reel 25 and with the wheels of the pulleys aligned in a plane which is intermediate the sides 40 of hose reel 25. An anchor 55 is provided on the floor 31 of chassis 12 rearwardly of hose reel 25 and generally adjacent the front wall 30** of the water tank.

A first cable 60 is coupled to the free end of plate 52 and cable 60 passes forwardly and then under and over the first pulley 53 so that it is directed toward the rear of the cleaner 10. The other end of cable 60 is attached to a first end 62 of extension spring 61 located intermediate pulleys 53 and 54. A second cable 64 is coupled to the opposite end 63 of spring 61 and passes down over the second pulley 54 toward anchor 53. Finally, another extension spring 65 is connected between cable 64 and anchor 53.

The length of cables 60 and 64 and the length and tension of springs 61 and 65 are selected so that when the hose reel 25 is full of hose 22, as is shown in FIG. 3, the springs are at maximum tension. The springs 61 and 65 should maintain tension on chain 47 during the movement of plate 52 toward pully 53 as will be explained below.

Figure 4:
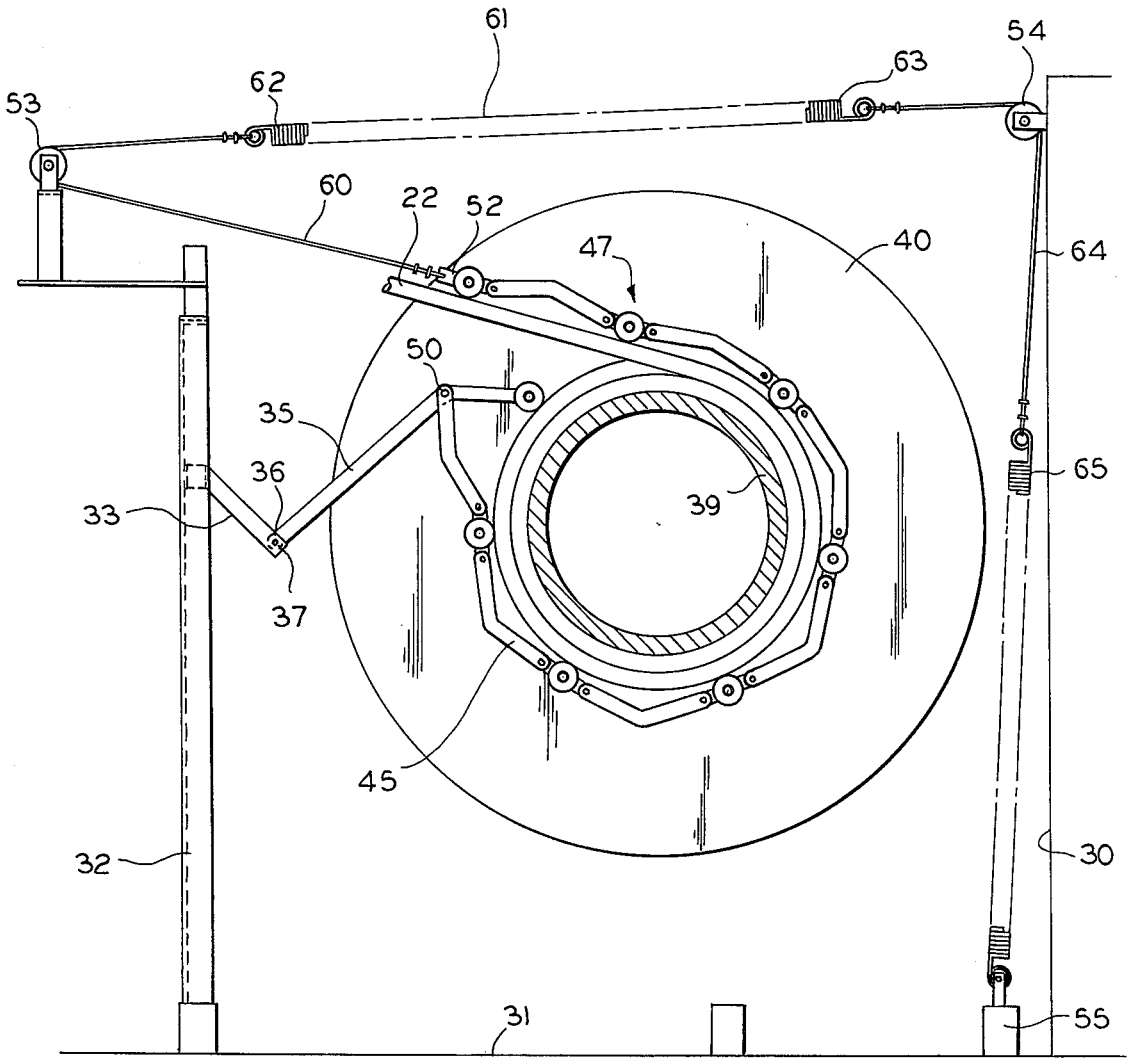
FIG. 4 is a detailed side view of the hose reel apparatus according to the preferred form of the present invention showing the reel substantially emptied of hose.
Figure 5:
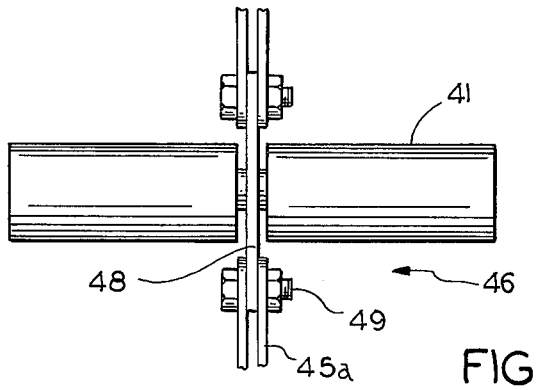
FIG. 5 is a view taken along the line 5—5 of FIG. 3 showing one roller mounting and link connecting assembly of the present invention.

By reference to FIG. 4, the operation of the hose restraint system of the present invention may be more fully understood. In this FIGURE, the hose 22 has been substantially completely unwound from reel 25. During unwinding of the hose 22, the diameter of the windings has decreased causing plate 35 to assume a more horizontal orientation with respect to the floor 31 of chassis 12. In turn, the springs 61 and 65 have pulled plate 52 towards pulley 53 and the number of rollers 41 contacting the circumference of the hose windings has decreased. The entire link chain 47 has been drawn about a constantly decreasing circumference while rollers **38*a* and 41 maintained contact against the windings to prevent fouling of the hose or backlash. As mentioned previously, the removal of the hose may be accomplished manually, or a positive drive means may be coupled to hose reel 25**. While the latter is the preferred system, it will not be described in detail because in and of itself, it forms no part of the present invention.

The power reel drive means, preferably hydraulic drive means, is also provided for rewinding hose 22 on hose reel 25 to the position shown in FIG. 3. The hose, as it is being rewound passes beneath the rollers **38*a* and 41 while the spring tension is gradually increased and more and more of the rollers come into contact with the hose windings. The rollers, due to the spring tension and due to the radial restraint on the hose movement imposed by the rollers and the side walls 40 of reel 25, evenly distributes the hose 22 over the width of the hose reel 25 and smooth out any piles of windings which may develop. Hose 22 is thus prevented from spilling over the reel 25** and fouling the reel drive mechanism.

While the present invention has been described and illustrated in connection with a single preferred embodiment, the invention is not to be limited thereby as numerous variations will be apparent to those skilled in the art. For example, the extension springs 61 and 65 may be replaced by other tensioning devices. Coil springs, resembling the type of springs used in watch main springs, can be used and they take up less room than that required for the illustrated type of extension springs 61 and 65. Such springs are used in other types of devices such as the reels on gas station lubrication and air hoses, and it is within the scope of the present invention that cable 60 and 64 can be wound on spring loaded drums to minimize the space requirements of the tension system and avoid potential interference of the springs and cables with the hose. Such spring loaded helical wound spring return reels also may be employed to eliminate the need for pulleys.

The hose reel system of the present invention can be equally well adapted to vertically mounted reels such as the one illustrated, or to horizontally mounted reels, and the reels can be used for storage of a wide variety of materials, including cable strands and hose materials. Accordingly, the invention is not to be limited to the foregoing preferred embodiment but is to be limited solely by the claims which follow:

We claim:

1. A reel system for storing, supplying and winding elongate materials comprising:

a reel mounted upon a support for being rotated for winding or unwinding said elongate material, said reel including parallel side walls and a cylindrical core extending perpendicularly therebetween;

supports means adjacent said reel;

an elongate link assembly, a first end of said link assembly being pivotally mounted to said support means, said link assembly including rollers each having an axis parallel to the axis of said reel and said assembly encircling at least a substantial amount of the circumference of the windings of elongate material provided on said reel; and means for maintaining tension on said link assembly whereby contact is maintained by said rollers on said windings regardless of the circumference of windings upon said reel.

2. The inventions set forth in claim 1 wherein said link assembly comprises an elongate chain of pivotally connected link members and rollers being perpendicularly deposed thereto, said rollers having a width which is slightly less than the width of said cylindrical core.

3. The invention set forth in claim 2 wherein said rollers are adapted for axial rotation in response to rotation of said reel an the winding or unwinding of hose therefrom.

4. The invention set forth in claim 3 wherein said tension maintaining means comprises spring means.

5. The invention set forth in claim 4 wherein a first end of said link assembly is rotatably secured to said support means and said chain is wrapped around said reel whereby at least a plurality of said rollers engage said windings, and wherein spring means engage the other end of chain for maintaining contact between said rollers and said elongate material windings regardless of the circumference thereof.

6. The invention set forth in claim 5 wherein anchor means is provided for said spring means and said tension maintaining system also includes at least one cable for creating said tension in the direction of elongate material feed from said reel.

7. A hose reel storage, winding and unwinding system comprising:

a reel mounted for rotation about its axis, said reel including two circular parallel sides and a cylindrical core mounted perpendicularly therebetween;

a quantity of hose wound on said reel;

a support frame adjacent said reel;

an elongate link and roller assembly, a first end of which is rotatably mounted to said support frame, said assembly including a plurality of elongate link plates pivotally connected to roller plate members, rollers coupled to said roller plate members for axial rotation and the combined width of said rollers and roller plate member being just slightly less than the width of said cylindrical drum, said link and roller assembly being wrapped around at least a substantial portion of the circumference of the windings of hose on said reel; and means for pulling the second end of said link and roller assembly around said windings to cause said rollers to press on the hose windings, said pulling means being selected whereby at least a portion of said rollers are maintained in contact with the outer circumference of said hose reel regardless of the circumference of the hose windings thereon.

8. The invention set forth in claim 7 wherein said pulling means comprises cable means coupled to the second end of said link and roller assembly and spring means coupled to said cable means.

9. The invention set forth in claim 8 wherein said pulling means is constructed for pulling said second end of said link and roller assembly in the general direction of hose feed from said reel.

* * * * *